US006099176A

United States Patent [19]

Miazga

[11] Patent Number: 6,099,176

[45] **Date of Patent: *Aug. 8, 2000**

[54] METHOD AND APPARATUS FOR ADJUSTING LATERAL IMAGE REGISTRATION IN A MOVING WEB PRINTER

[75] Inventor: Jay M. Miazga, Marysville, Wash.

[73] Assignee: Intermec IP Corp., Woodland Hills, Calif.

[ * ] Notice: This patent is subject to a terminal disclaimer.

[21] Appl. No.: 09/000,901

[22] Filed: Dec. 30, 1997

Related U.S. Application Data

[63] Continuation of application No. 08/522,033, Aug. 31, 1995, Pat. No. 5,733,054.

[51] Int. Cl.[7] ..... B41J 2/315

[52] U.S. Cl. ..... 400/120.16; 400/120.17

[58] Field of Search ..... 400/120.01, 120.16, 400/120.17

[56] References Cited

U.S. PATENT DOCUMENTS

| | | | |
|---|---|---|---|
| 4,501,508 | 2/1985 | Potter . | |
| 5,227,809 | 7/1993 | Carpenter et al. . | |
| 5,473,984 | 12/1995 | Terrell, Jr. et al. . | |
| 5,507,582 | 4/1996 | Mistyurik . | |
| 5,528,277 | 6/1996 | Nardone et al. | 347/198 |

*Primary Examiner*—John S. Hilten
*Attorney, Agent, or Firm*—O'Melveny & Myers LLP

[57] ABSTRACT

In a label printer having a printhead mounted above a path for printing on labels carried by a backing strip along the path, this invention is apparatus for adjusting the lateral position of the printhead over the labels. A first member is fixedly carried by the printer over the path. A second member carries the printhead while third member connects the second member to the first member for lateral movement relative to the first member. Finally, there is adjusting apparatus for selectively setting a lateral position of the second member relative to the first member.

6 Claims, 4 Drawing Sheets

METHOD AND APPARATUS FOR ADJUSTING LATERAL IMAGE REGISTRATION IN A MOVING WEB PRINTER

RELATED APPLICATION

This application is a continuation of application Ser. No. 08/522,033, filed Aug. 31, 1995, now issued on Mar. 31, 1998 as U.S. Pat. No. 5,733,054.

BACKGROUND OF THE INVENTION

1. Techinical Field

This invention relates to printers for printing on a moving web and, more particularly, to a method and associated apparatus for adjusting the lateral position of the printhead over the labels in label printers having a printhead mounted above a path for printing on labels carried by a backing strip along the path comprising the steps of, mounting the printhead over the path for adjustable lateral movement; moving a backing strip with labels thereon along the path until lateral stability is established; and, adjusting the lateral position of the printhead over the labels to a desired position with respect to the labels.

2. Background Art

In a label printer such as that generally indicated as 10 in FIG. 1, a plurality of labels 12 are releasably attached to a backing strip 14 forming a strip of media 15 that extends from a supply roll 16 over a plurality of guide rollers 18 to a printhead 20. At the printhead 20, ink from a ribbon 22 extending between a supply roll 24 and a take-up roll 26 is transferred to the labels 12. After printing, the labels 12 are separated from the backing strip 14 by a separator 27 and the backing strip 14 is wound onto a take-up roll 28 for later disposal. The labels 12 and backing strip 14 are moved in combination from the supply roll 16 to the printhead 20 by a driven platen roller roller 30 which also supports the labels 12 and backing strip 14 under the printhead 20 during the printing process. To keep the cost of the printer 10 low, the take-up roll 26, the take-up roll 28, and the platen roller roller 30 are all driven directly or indirectly by a single stepping motor 32 as indicated by the dashed lines. The movement of the stepping motor 32 is under the control of logic 34.

In label printing as in many areas, simplicity and cost are major factors. Consumers want the print quality they require in the least expensive printer. This is particularly true in on demand label printers. And, the introduction of small, narrow labels such as employed as labels for printed circuit boards printed in the "picket fence" mode have made the problem even more severe. Accurate lateral placement of the printing on these small labels is critical—particularly if there is any pre-printed material on them. And, at the same time, the cost of the printer is to remain low. Usually, such factors are a trade-off. That is, accurate placement can be obtained in a highly-complicated, high-cost printer. The prior art does not provide a way of obtaining both.

The problem is best understood with primary reference to FIG. 2 in combination with FIG. 1. If the guide rollers 18, platen roller 30, supply roll holding shaft 42, and the take-up roller 28 were all perfectly parallel to one another, the media 15 might be laterally positioned in the same place from one printer 10 to another. The fact is that they are not perfectly parallel. All mechanical devices are built to tolerances. And, it is a fact of manufacturing that the higher the tolerances, the more expensive the manufacturing process. Thus, if one is building a printer with low cost as an objective, the tolerances have to be lower in order to attain that objective. In addition, the lateral positioning of the labels 12 on the backing 14 are subject to tolerance variations. As a result, when the media 15 is loaded into various printers 10 of the same type, it will seek a stable lateral position under the printhead 20. If we use one edge 32 of the platen roller 20 as a lateral reference point, there will be varying space "EP" between the edge 32 and the edge 34 of the backing 16 and a varying space "EW" between the edge 34 of the backing strip 14 and the edge 36 of the labels 12. Thus, if one is required to exactly position the printhead 20 over the path of the labels 12 in order to accurately print new information in relation to pre-printed information on the labels 12, it is an impossible task using prior art techniques. This can be seen in FIG. 3 which depicts the prior art approach to mounting the printhead 20.

A shaft 38 is carried for rotation by two end bearings 39 between two sidewalls 40 of the printer 10 above and slightly behind the platen roller 30. A block 42 is fixedly mounted for rotation with the shaft 38. The lateral position of the block 42 is fixed on the shaft 38. A second shaft 50 extends outward perpendicular to the front face of the block 42. The printhead 20 is rotatably mounted on the second shaft 50. Through the use of adjusting screws (not shown), the printhead 20 can thus be adjusted to be parallel to the platen roller 30 by rotating it around the second shaft 50 and can be adjusted as to it spacing above the platen roller 30 (and, therefore, above the labels 18), by rotating the block 42 and the shaft 38 in combination. As can be seen, there is no lateral adjustability. So, the lateral positioning of the labels 12 under the printhead 20 varies from printer to printer as a function of the variations in tolerances as described above.

Wherefore, it is an object of the present invention to provide methods and apparatus for making a low-cost web printer in which the lateral positioning of the printhead is repeatable from printer to printer.

It is another object of the present invention to provide methods and apparatus for making a low-cost label printer in which the lateral positioning of the printhead on the labels is repeatable from printer to printer without regard to positional variations caused by printer and media production tolerances.

It is still another object of the present invention to provide methods and apparatus for making a low-cost label printer in which the lateral positioning of the printhead on the labels is dynamically adjustable to account for positional variations caused by printer and media production tolerances, and the like.

Other objects and benefits of this invention will become apparent from the description which follows hereinafter when read in conjunction with the drawing figures which accompany it.

SUMMARY

The foregoing objects have been achieved in a label printer having a printhead mounted above a path for printing on labels carried by a backing strip along the path, by the apparatus of the present invention for adjusting the lateral position of the printhead over the labels comprising, a first member fixedly carried by the printer over the path; a second member carrying the printhead; a third member connecting the second member to the first member for lateral movement relative to the first member; and, adjusting apparatus for selectively setting a lateral position of the second member relative to the first member.

In the preferred embodiment, the adjusting apparatus comprises, a first threaded member carried by the first member; and, a second threaded member carried by the second member threadedly engaged with the first threaded member so that the lateral position of the second member relative to the first member is set by changing degree of threaded engagement of the second member and the first member.

In a manual embodiment, the second threaded member includes a means for manually changing the degree of threaded engagement of the second member and the first member.

In an automated embodiment, the second threaded member includes a driven means for changing the degree of threaded engagement of the second member and the first member; and it further includes, a sensor sensing the lateral position of the printhead over the labels and control logic connected between the sensor and the driven means which uses the driven means to position the printhead at a desired lateral position over the labels.

DESCRIPTION OF THE PREFERRED EMBODIMENT

Figure 1:
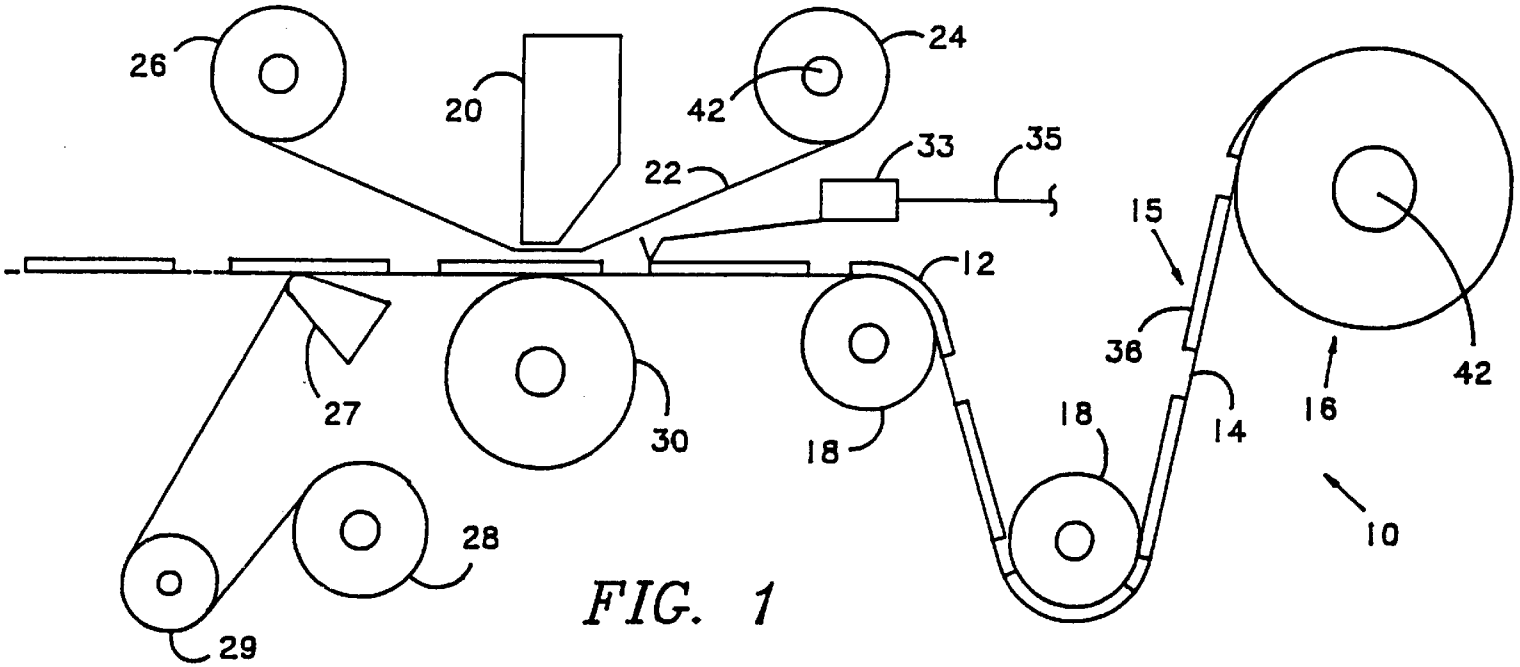
FIG. 1 is a simplified side view of a label printer for printing on a moving web of labels as wherein the present invention is employed.
Figure 2:
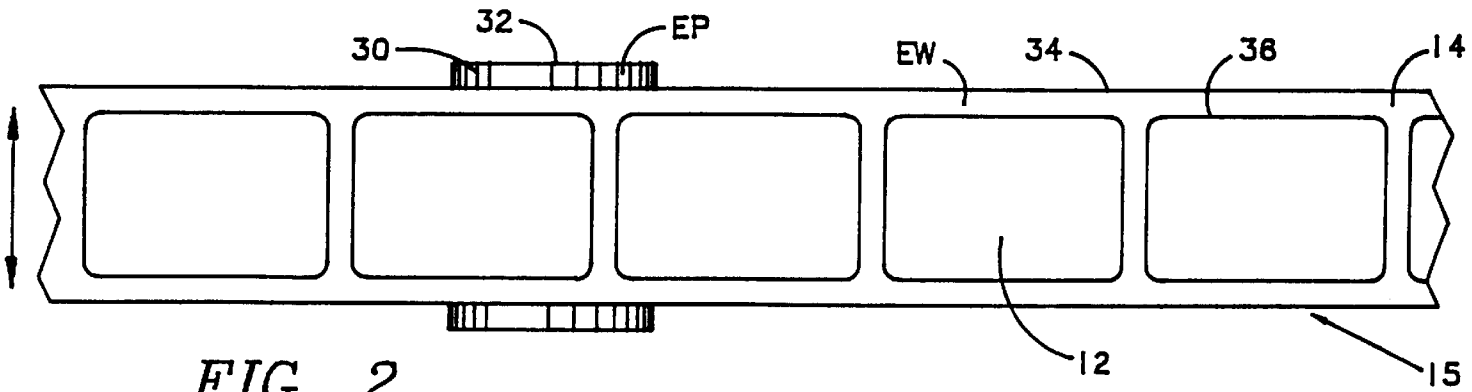
FIG. 2 is a simplified top view of a portion of the printer of FIG. 1 showing the problem of side registration solved by the present invention.
Figure 3:
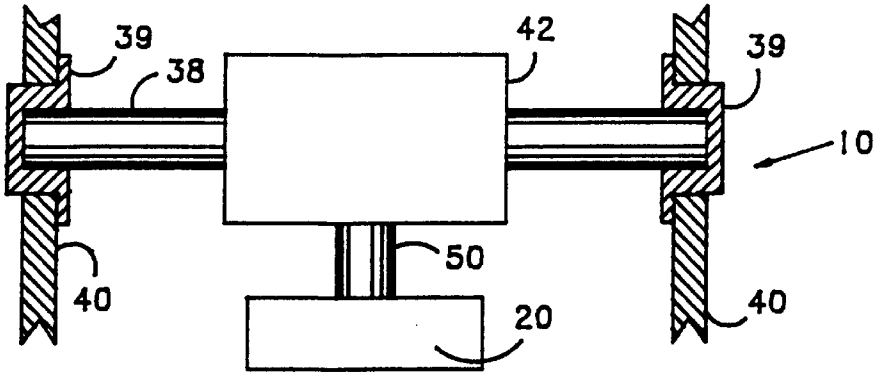
FIG. 3 PRIOR ART
FIG. 3 is a detailed top view of printhead mounting apparatus according to the prior art.
Figure 4:
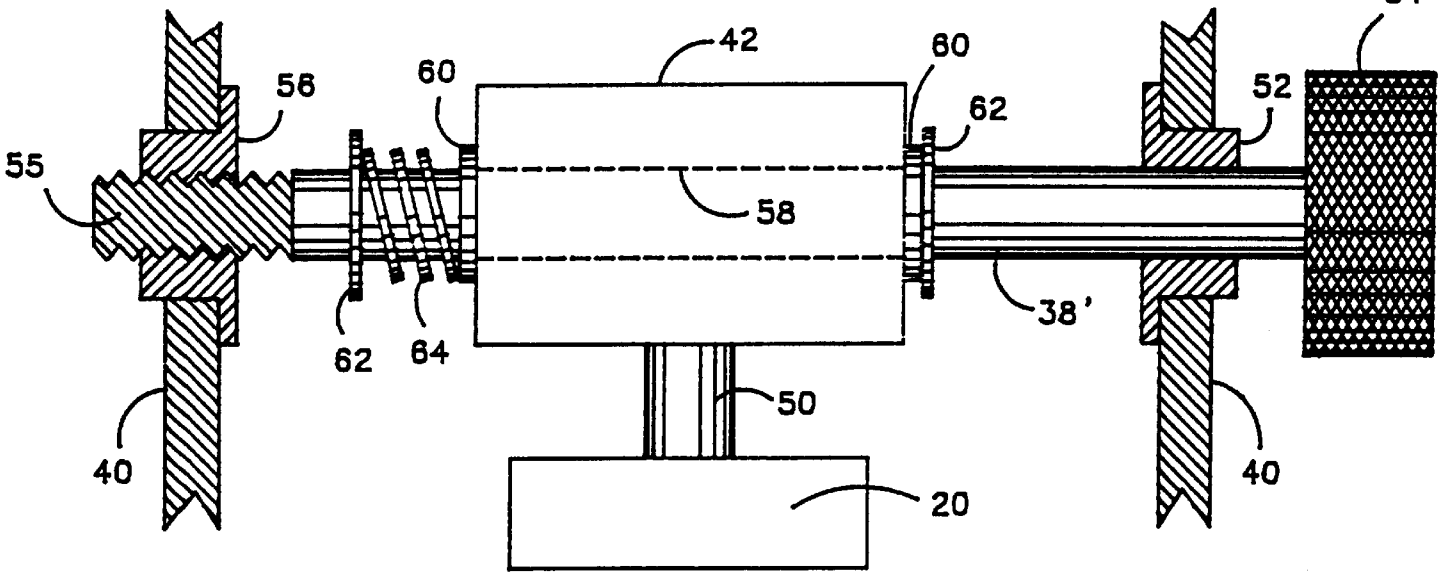
FIG. 4 is a detailed top view of printhead mounting apparatus according to the present invention.
Figure 7:
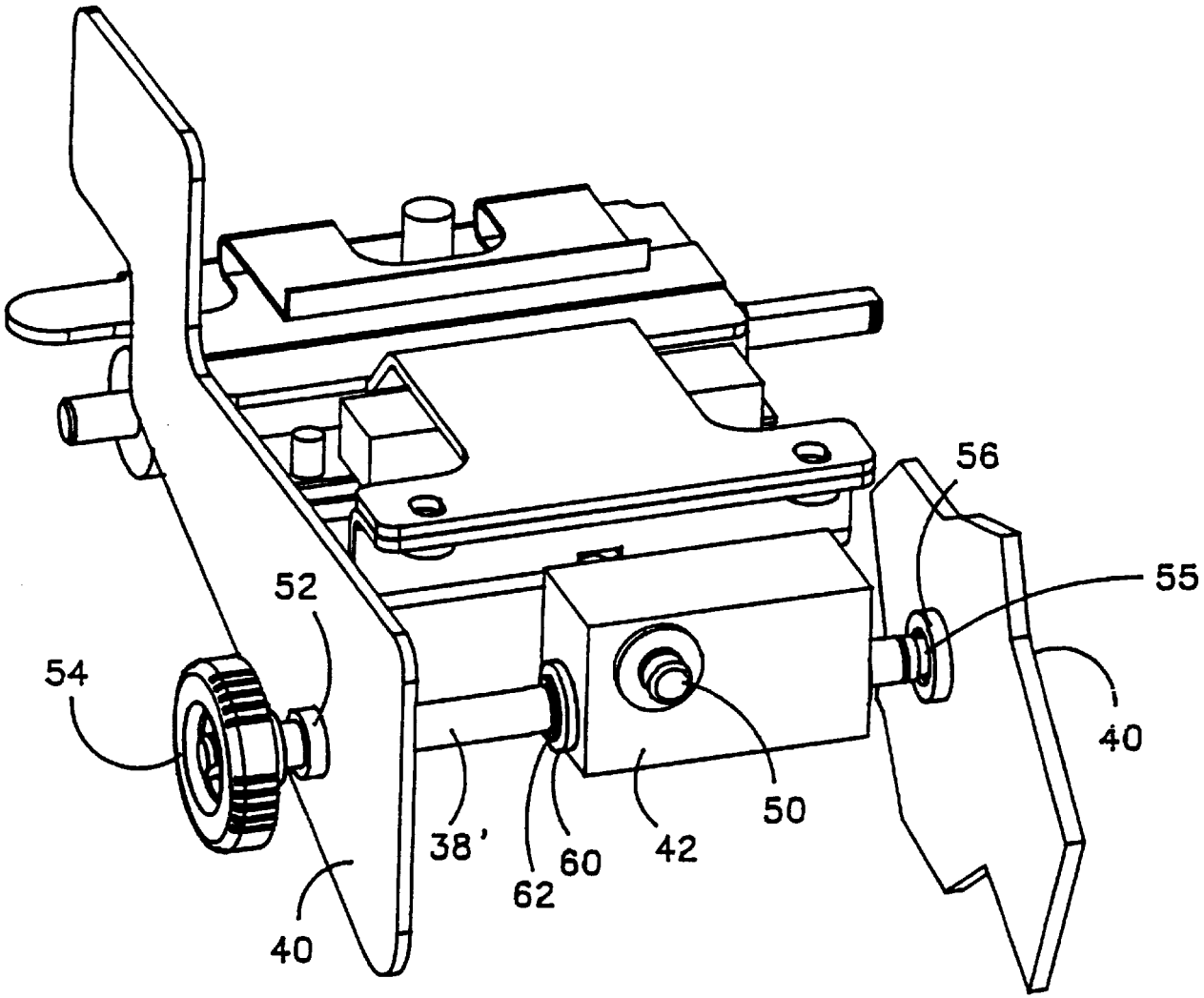
FIG. 7 is a perspective view of apparatus according to the present invention as will be incorporated into a commercial label printer.

A first embodiment of the present invention which is manually adjustable to accurately laterally position the printhead 20 is depicted in FIGS. 4 and 7. Like parts as compared with the prior art of FIG. 3 are labeled with like numbers. In the apparatus of the present invention of FIG. 4, the shaft 38' is no longer rotationally carried between the sidewalls 40 of the printer and fixedly attached to the block 42. Rather, the shaft 38' is rotatably carried on one end by a bearing 52 in one sidewall 40 and has an adjusting knob 54 attached to that end. The other end 55 of the shaft 38' is threaded and threadedly engaged in a threaded member 56 carried by the other sidewall 40. Moreover, the shaft 38' rotationally passes through a bore 58 in the block 42 having bearings 60 at its two ends; and, the block 42 is laterally positioned on the shaft 38' by an E-ring 62 on one side and an E-ring 62 in combination with a spring 64 on the other side. As a result, the block 42 carrying the printhead 20 is now laterally adjustable, making the printhead 20 laterally adjustable as well. As the knob 54 is rotated one way or the other, the threaded end 55 of the shaft 38' is threaded into or out of the threaded member 56. Being laterally contained on the shaft 38', the block 42 and printhead 50 are, therefore, moved left and right as FIG. 4 is viewed. Thus, each printer 10 employing the present invention can be adjusted to exactly and repeatedly position the printhead 20 laterally over the labels 18.

Figure 5:
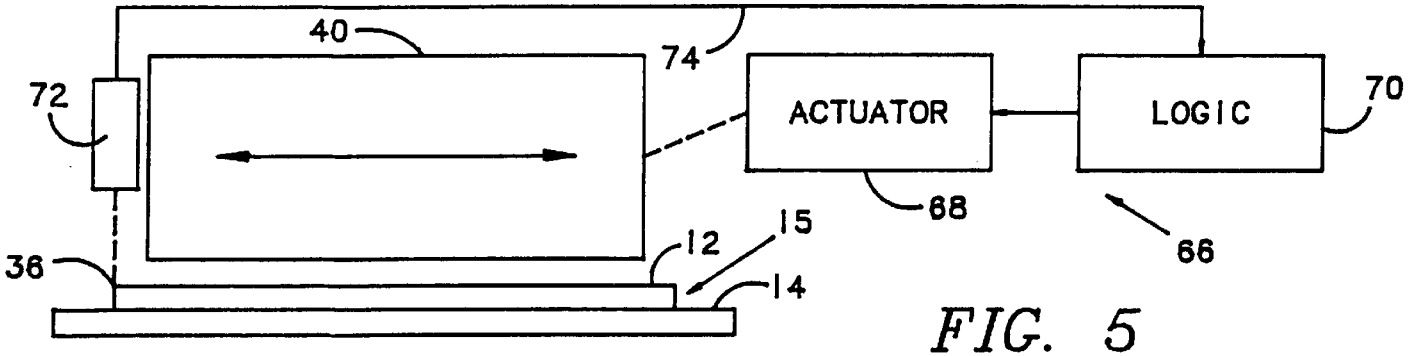
FIG. 5 is a simplified functional block diagram of an automated embodiment of the present invention.

There may be situations in which it is possible for the media 15 to dynamically wander laterally across the platen roller 30. For example, wobble in either the supply roll 16 or the take-up roller 28 might induce dynamic variations in the lateral position of the backing strip 14 by causing differences in lateral forces. In such a situation, the automated lateral positioning system of FIG. 5 is preferred. In the system 66 of FIG. 5, the printhead 20 is mounted for lateral adjustment on shaft 38' as in FIG. 4. The knob 54, however, is replaced (or supplemented) by a rotary actuator 68, such as a stepping motor. The actuator 68 is driven by logic 70. In addition, the printhead 20 carries an edge detector 72 of any convenient type well known to those of ordinary skill in the art. For example, a mechanical finger could sense the change in thickness or height at the edge 36. For another example, a light source on one side and a light sensor on the other side of the media 15 could sense the change in thickness at the edge 36. The output 74 from the edge detector 72 is fed back to the logic 70, which can be such as depicted in the flow diagram of FIG. 6. The logic 70 inputs the signal from the edge detector 72 and checks to see if the edge is within pre-established limits. If not, it checks to see if the printhead 20 is outside of the edge limit or inside. If it is outside, the logic 70 uses the actuator 68 to move the printhead 20 in a step. It then returns to the start of the loop to check if the correction made is sufficient. If the printhead 20 is inside, the logic 70 uses the actuator 68 to move the printhead 20 out a step. Again, it then returns to the start of the loop to check if the correction made is sufficient. As long as the printhead 20 is positioned within limits, the logic 70 simply continues to check. As long as the printhead 20 is out of limits, the logic 70 will continue to correct until it is back in limits.

Figure 6:
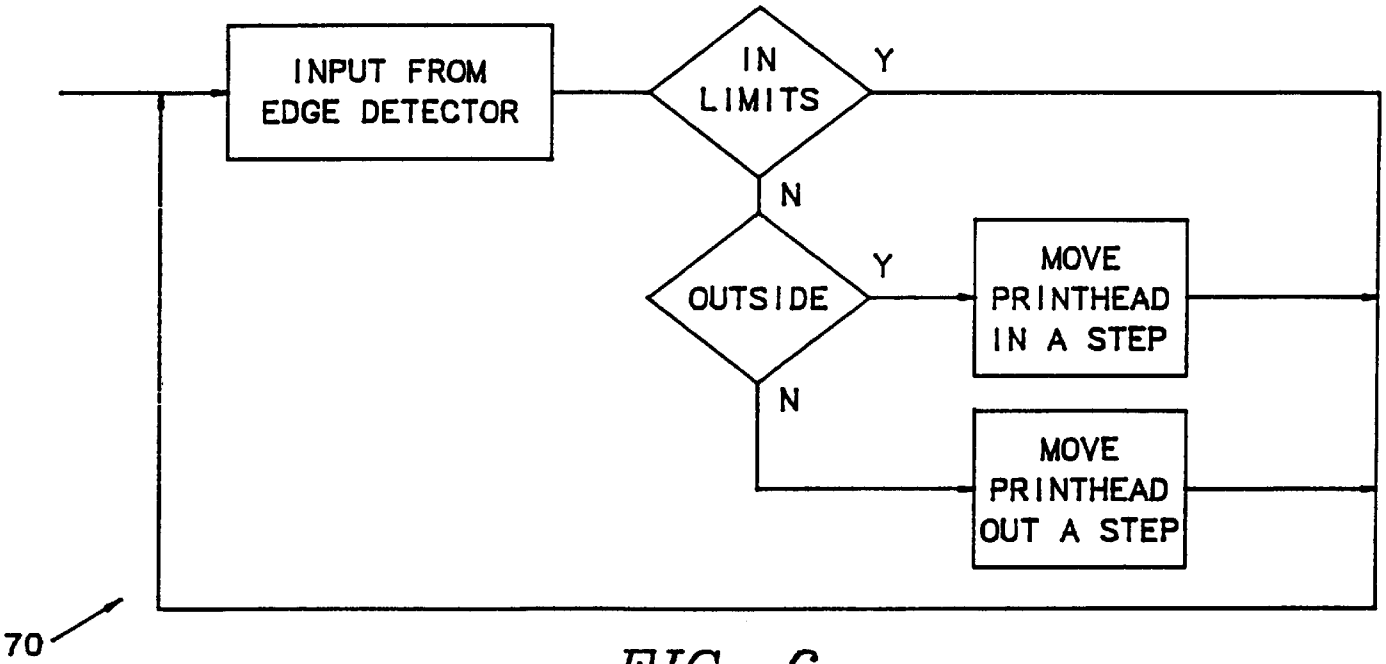
FIG. 6 is a flowchart of exemplary logic that can be used in the automated embodiment of FIG. 5.

Note that the logic 70 of FIG. 6 is by way of example only and other logic approaches within the scope and spirit of the present invention will be readily apparent to those of ordinary skill in the art. Regardless of the actual logic performed or the sensor employed, this approach of the present invention is accomplished dynamically while printing takes place so that any changes that may occur in lateral positioning are automatically corrected for regardless of the cause.

Wherefore, having thus described the preferred embodiment, what is claimed is:

1. In a label printer, an apparatus for adjusting the lateral position of a printhead over a print path, comprises:

a support structure fixedly provided by said label printer;

a shaft rotatable attached to said support structure;

a holding member attached to said shaft for holding said printhead over the print path;

a driving motor for rotating said shaft;

a sensor for sensing the lateral position of said printhead in relation to the labels; and control logic connected between said sensor and said driving motor which controls said driving motor to position said printhead at a desired lateral position, wherein the lateral position of said printhead relative to said support structure is set by rotating said shaft.

2. In a printer having a printhead mounted above a path for printing on labels carried by a backing strip along said path, an apparatus for adjusting the lateral position of said printhead comprising:

a support structure fixedly provided by said label printer;

a shaft rotatably attached to said support structure;

a holding member attached to said shaft for holding said printhead, said holding member positioned at a fixed point along the length of said shaft;

adjusting means for setting the lateral position of said printhead relative to said support structure by rotating said shaft.

3. In a printer having a printhead mounted above a path for printing on labels carried by a backing strip along said path, an apparatus for adjusting the lateral position of said printhead comprises:

a support structure fixedly provided by said label printer;

a shaft rotatably attached to said support structure;

a holding member attached to said shaft for holding said printhead, said holding member positioned at a fixed point along the length of said shaft;

adjusting means for setting the lateral position of said printhead relative to said support structure by rotating said shaft, said adjusting means further comprises:

a threaded member attached to said support structure; and a threaded endpiece attached at a first end of said shaft, said threaded endpiece threadedly engaged with said threaded member so as to move laterally relative to said threaded member as said shaft is rotated.

4. The apparatus of claim 3 wherein said adjusting means further comprises means for manually rotating said shaft.

5. The apparatus of claim 3 wherein said adjusting means further comprises:

a driving motor for rotating said shaft;

a sensor for sensing the lateral position of said printhead in relation to the labels; and control logic connected between said sensor and said driving motor which controls said driving motor to position said printhead at a desired lateral position.

6. In a printer having a printhead mounted above a path for printing on labels carried by a backing strip along said path, a method for adjusting the lateral position of said printhead over said path, comprising the steps of:

mounting said printhead on a shaft such that the lateral position of said printhead relative to said shaft is fixed; and adjusting the printhead to a desired lateral position with respect to the labels by rotating said shaft, wherein said step of adjusting the printhead to a desired lateral position comprises the steps of:

using a sensor to determine the lateral position of the printhead over the labels; and automatically rotating said shaft to change the lateral position of said printhead over the labels until the desired position is sensed by the sensor.

* * * * *